US006386542B1

(12) United States Patent
Lore

(10) Patent No.: US 6,386,542 B1
(45) Date of Patent: May 14, 2002

(54) UNIQUE PUZZLE AND PUZZLE PIECE

(76) Inventor: Nick Lore, 45 Edison Ave., West Babylon, NY (US) 11704

( * ) Notice: Subject to any disclaimer, the term of this patent is extended or adjusted under 35 U.S.C. 154(b) by 0 days.

(21) Appl. No.: 09/723,320

(22) Filed: Nov. 27, 2000

(51) Int. Cl.[7] ..... A63F 9/08
(52) U.S. Cl. ..... 273/156; 273/161; 446/125
(58) Field of Search ..... 273/157 R, 156, 273/153 R, 161; 446/124, 125

(56) References Cited

U.S. PATENT DOCUMENTS 879,455 A * 2/1908 Frost ..... 446/124
3,442,044 A * 5/1969 Quercetti ..... 446/124
3,678,613 A * 7/1972 Geymeier ..... 446/124
3,819,188 A * 6/1974 Freedman ..... 273/157 R
3,919,785 A * 11/1975 Generaux ..... 446/124
5,273,477 A * 12/1993 Adams, Jr. ..... 446/125

* cited by examiner

*Primary Examiner*—Steven Wong
(74) *Attorney, Agent, or Firm*—Thomas A O'Rourke; Wyatt Gerber & O'Rourke

(57) ABSTRACT

A puzzle piece and puzzle made from the pieces is disclosed. The puzzle piece has a center member having a first surface and a second surface, the first surface and the second surface have four long edges and four short edges. Each of the edges has a first end and a second end, and wherein a first two of the long edges meet to form an angle at one of their ends and at the other end of each of the long edges each edge meets and forms an angle with a short edge. A second two of the long edges meet to form an angle at one of their ends and at the other end of each of the long edges each edge meets and forms an angle with a short edge. Each of the short edges have a first and second end and two of the short edges meet to form an angle and the remaining two of the short edges meet to form an angle. The central member has four legs extending from each of the first and second surfaces.

22 Claims, 4 Drawing Sheets

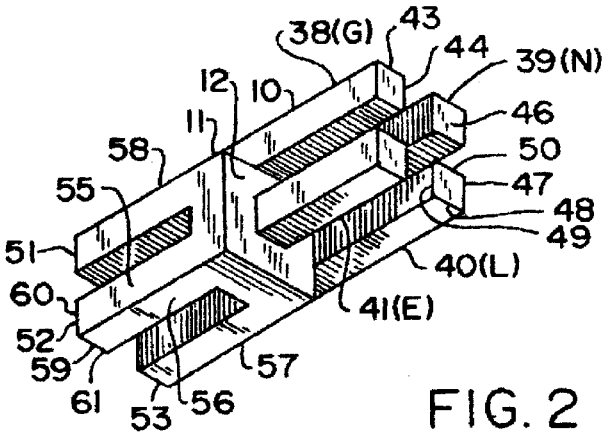
FIG. 2
FIG. 1B
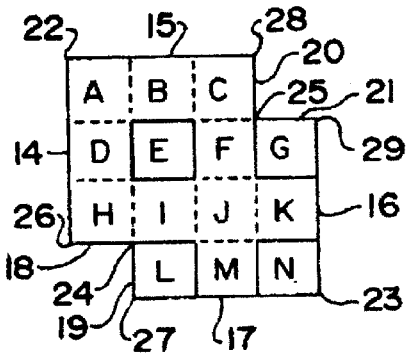
FIG. 1
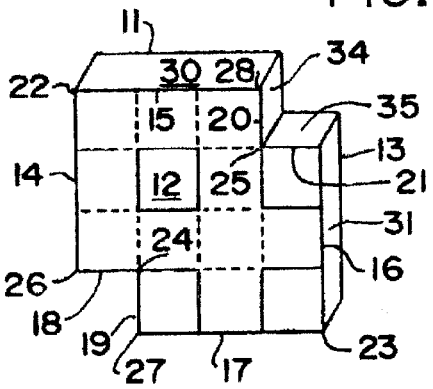
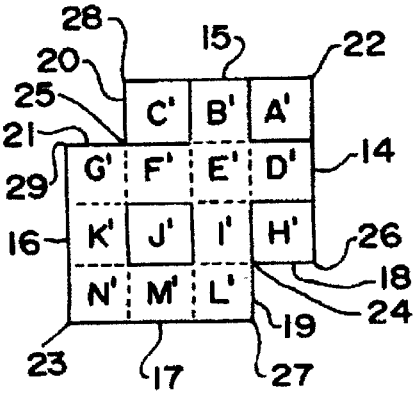
FIG. 1C
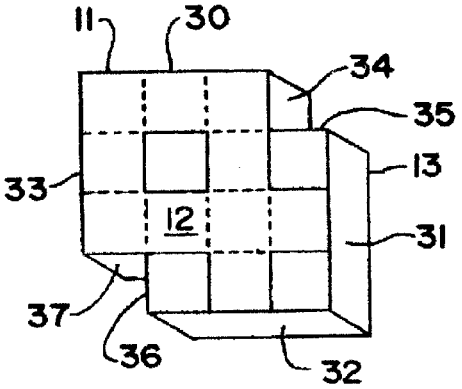
FIG. 1A

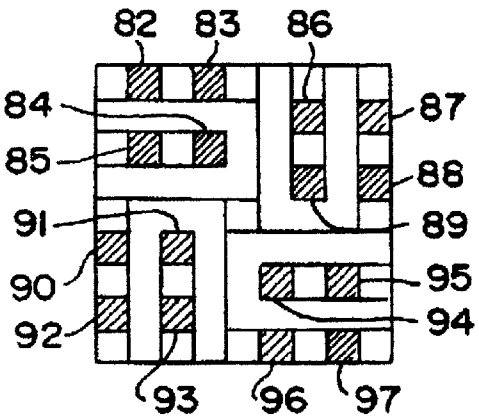
FIG. 9
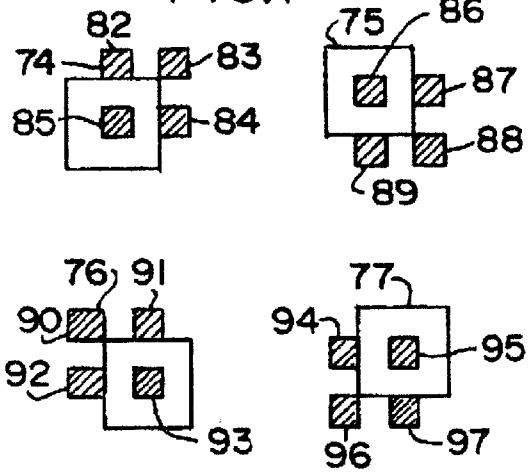
FIG. 7
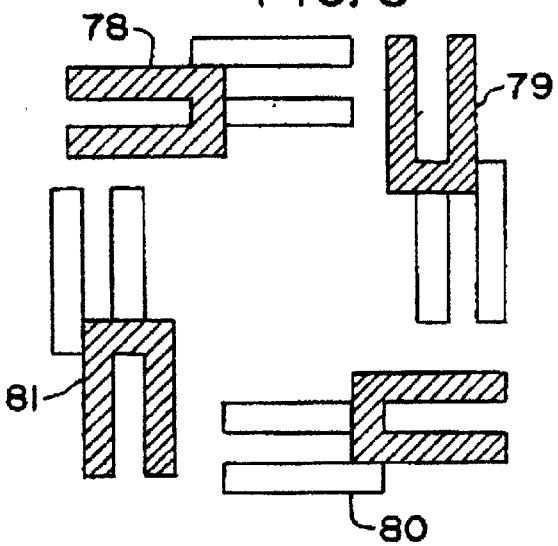
FIG. 8
FIG. 6

UNIQUE PUZZLE AND PUZZLE PIECE

FIELD OF THE INVENTION

The present invention relates to toys and more particularly a unique puzzle that is challenging for the user and which will give the user great enjoyment in solving the puzzle.

BACKGROUND OF THE INVENTION

Puzzles have a long history. The ancient Minoans on the Mediterranean island of Crete were noted for a maze that had at its center the mythical beast known as the Minotaur. One of the most famous puzzles in ancient times was the Gordian knot. When challenged to unravel this conundrum Alexander the great took a unique approach and cut the knot with his knife.

There has always been an interest in devising "problems" for the purpose of posing a challenge or providing intellectual pleasure. Similarly, people have always enjoyed the mental stimulation and challenge of solving problems. Many early puzzles could be divided into two types those involving the manipulation of objects, and those requiring computation. The first group includes for example, such well known puzzles as the "decanting and difficult crossings" problems. A typical example of the former is how to measure out one quart of a liquid if only an eight-, a five-, and a three-quart measure are available. Difficult crossings problems are exemplified by the dilemma of a farmer with a fox, a chicken and a bag of corn. They are trying to cross a stream in a boat that will hold only two items. The fox and chicken cannot be left alone nor can the chicken and the corn. Many variants of both types of problems have appeared over the years.

Another type of puzzle that has been popular involves the manipulation of geometric shapes and forms. One such type of puzzle is known as the Soma Cubes which were developed by Piet Hein of Denmark. These puzzles involved irregular shapes that can be formed by combining three or four congruent cubes joined at their faces. These congruent cubes could be put together to form a larger cube. There were seven such shapes, called Soma Cubes. No two shapes were alike, although the fifth and sixth are mirror images of each other. Many solid shapes could be formed from the seven Soma Cubes, shapes resembling, for example, a sofa, a chair, a castle, a tunnel, a pyramid, and so on. Even the assembling of the seven basic pieces into a large cube can be done in more than 230 essentially different ways.

There are a wide variety of puzzles involving colored square tiles and colored cubes. In one, the object is to arrange the 24 three-color patterns, including repetitions, that can be obtained by subdividing square tiles diagonally, using three different colors, into a rectangle so that each pair of touching edges is the same color and the entire border of the rectangle is the same color. A commercial colored-cube puzzle known as Instant Insanity, consisting of four cubes, each of which has its faces painted white, red, green, and blue in a definite scheme. The puzzle is to assemble the cubes into a prism such that all four colors appear on each of the four long faces of the prism. Since each cube admits of 24 different orientations, there are 82,944 possible prismatic arrangements; of these only two are the required solutions.

More recently, a few years ago the Rubik's cube was a popular puzzle. The cube appears to be composed of 27 smaller cubes, or cubelets; in its initial state, each of the six faces of the cube is made up of nine cubelet faces all of the same color. In the commercial versions of the puzzle, an internal system of pivots allows any layer of nine cubelets to be rotated with respect to the rest, so that successive rotations about the three axes cause the cubelet faces to become scrambled. The challenge of restoring a scrambled cube to its original configuration is formidable, inasmuch as more than $10^{19}$ states can be reached from a given starting condition.

SUMMARY OF THE INVENTION

The present invention is directed to a unique puzzle that is made up of twelve generally identical puzzle piece that interconnect to form a cube. Each of the puzzle pieces has center member. The center member has a first surface and a second surface. The first surface and the second surface each have four long edges and four short edges. Two long edges meet to form an angle at one of their ends. At the other end of each edge the edges meet and forms an angle with short edge. Each of the short edges meet to form an angle. Extending outwardly from each surface are four legs. Twelve puzzle pieces intermesh to form a cube. One feature of the cube of the preferred embodiment of the present invention is that the cube is capable of balancing on any one of its corners.

BRIEF DESCRIPTION OF THE DRAWINGS

FIG. 1 is a perspective view of the central member of a puzzle piece of the present invention.

FIG. 1A is an alternative perspective front view of the central member of FIG. 1.

FIG. 1B is a view of the first surface of the central member of FIG. 1.

FIG. 1C is a view of the second surface of the central member of FIG. 1.

FIG. 2 is a perspective view of a puzzle piece of the present invention.

FIG. 6 is an exploded view of four puzzle pieces that lie horizontally and intermesh to form the base of the finished cube.

FIG. 7 shows an exploded view of the four puzzle pieces that stand vertically and intermesh with the base of FIG. 6.

FIG. 8 is an exploded view of four puzzle pieces that lie horizontally and intermesh to form the top of the finished cube.

FIG. 9 is a top view of the intermeshed puzzle pieces of FIGS. 6, 7 and 8.

DETAILED DESCRIPTION OF THE INVENTION

Figure 3:
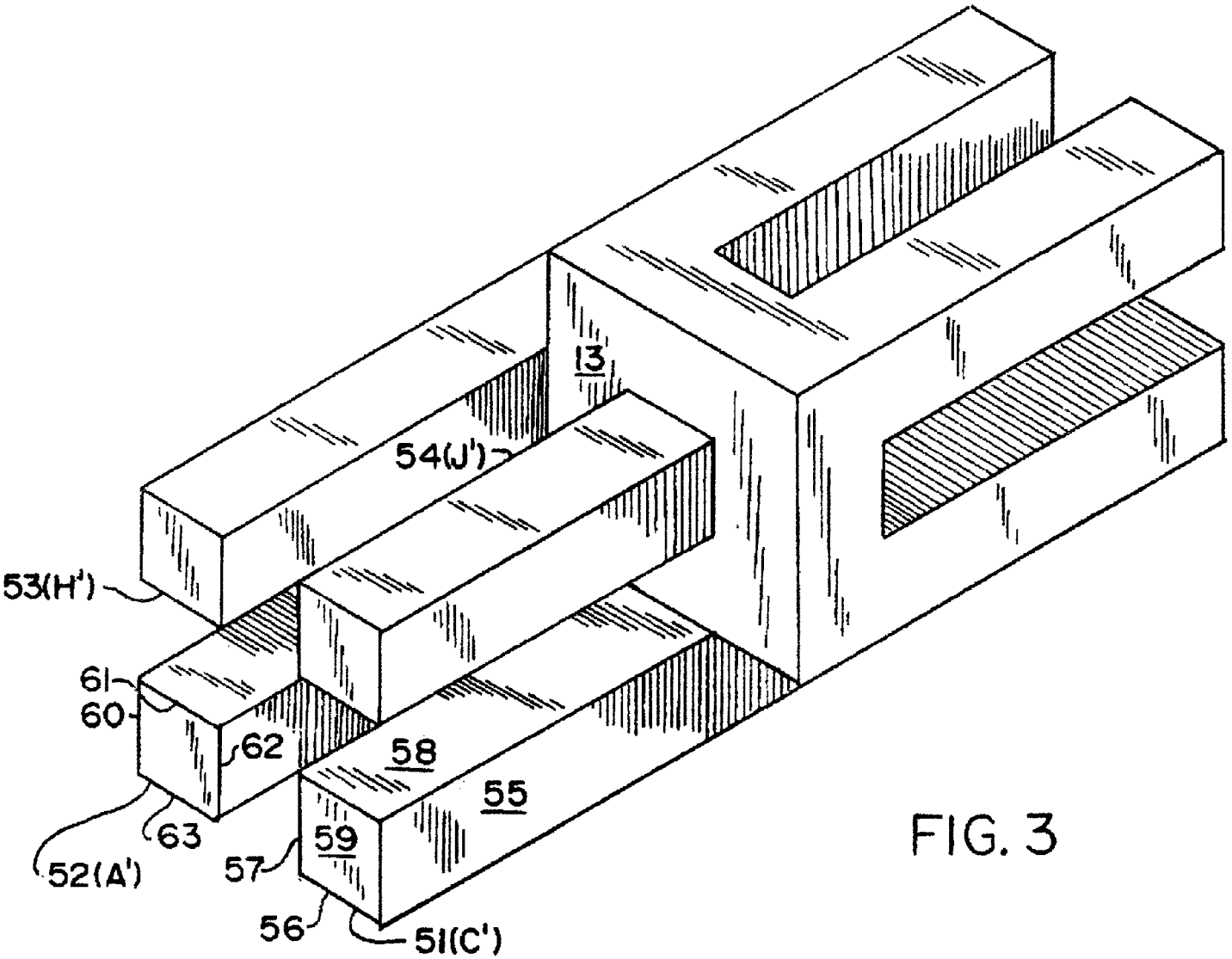
FIG. 3 is a perspective view of the opposite end of the puzzle piece of FIG. 2

As seen in FIGS. 1, 1A, 1B and 1C a puzzle piece 10 of the present invention is comprised of a center member 11. Center member 11 has a first surface 12 and a second surface 13. The first surface 12 and the second surface 13 each have four long edges 14, 15, 16, and 17 and four short edges 18, 19, 20 and 21. Long edges 14 and 15 meet to form an angle at one of their ends. At the other end of edge 14, long edge 14 meets and forms an angle with short edge 18. At the other end of edge 15, edge 15 meets and forms an angle with short edge 20. Long edges 16 and 17 meet to form an angle at one of their ends. At the other end of edge 16, long edge 16 meets and forms an angle with short edge 21. At the other end of edge 17, edge 17 meets and forms an angle with short edge 19.

In a preferred embodiment long edges 14 and 15 meet at generally a right angle at corner 22. Similarly, long edges 16 and 17 meet at generally a right angle at corner 23. Short edges 18 and 19 meet at generally a right angle at corner 24. Short edges 20 and 21 meet at generally a right angle at corner 25. Long edge 14 and short edge 18 meet at generally a right angle at corner 26. Long edge 17 and short edge 19 meet at generally a right angle at corner 27. Long edge 15 and short edge 20 meet at generally a right angle 28. Long edge 16 and short edge 21 meet at generally a right angle 29. As seen in FIG. 1 the relationship of the edges are the same for first surface 12 and second surface 13. The long edges are generally equal in length to each other. The short edges are also generally equal in length to each other. The length of each short edge is approximately one third the length of each long edge.

First surface 12 and second surface 13 are separated from each other by sidewalls 30, 31, 32, 33, 34, 35, 36 and 37. Sidewalls 30 and 33 meet at corner 22. Sidewalls 30 and 34 meet at corner 28. Sidewalls 34 and 35 meet at corner 25. Sidewalls 35 and 31 meet at corner 29. Sidewalls 31 and 32 meet at corner 23. Sidewalls 32 and 36 meet at corner 27. Sidewalls 36 and 37 meet at corner 24. Sidewalls 37 and 33 meet at corner 26. In the preferred embodiment of the present invention, the distance from the first surface 12 to the second surface 13 is the same as the length of any one of the short edges.

Extending outwardly from the first surface 12 are four legs 38, 39, 40, and 41. The placement of the legs on the first surface is important. As seen in FIG. 1B, the face of the first surface can be divided into 14 imaginary squares identified by the reference designations A through N. The leg 38 extending outwardly from the first surface extends from square G. The leg 39 extending outwardly from the first surface extends from square N. The leg 40 extending outwardly from the first surface extends from square L. The leg 41 extending outwardly from the first surface extends from square E. Each of the legs 38, 39, 40 and 41 are generally square in cross section. Each leg has four sides 42, 43, 44 and 45.The length of each leg side, i.e., from the base 12 to the tip or end surface is generally the same. Each leg ends in leg end surface 46 that has four sides 47, 48, 49 and 50 representing the junction of the four sides of each leg with the leg end surface. Each of the sides 47 to 50 of the leg end surface 46 are preferably the same length as each of the other sides of the leg end surface. In the preferred embodiment each of the sides of the four leg surfaces are identical to each other. Preferably, the leg sides 42 and 44 are parallel to each other and leg sides 43 and 45 are parallel to each other. In addition, leg side 42 is perpendicular to leg sides 43 and 45. Similarly, leg side 44 is also perpendicular to leg sides 43 and 45.

Extending outwardly from the second surface 13 (See FIG. 3) are four legs 51, 52, 53, and 54. The placement of the legs on the first surface is critical. As seen in FIG. 1C, the face of the second surface can also be divided into 14 imaginary squares identified by the reference designations A' through N'. The location of each of these squares in FIG. 1C is the same as their location in FIG. 1B, such that imaginary square A corresponds to A' and imaginary square B corresponds to B', etc. The leg 51 extending outwardly from the first surface extends from imaginary square C'. The leg 52 extending outwardly from the first surface extends from square A'. The leg 53 extending outwardly from the first surface extends from square H'. The leg 54 extending outwardly from the first surface extends from square J'. Each of the legs 51, 52, 53 and 54 are generally square in cross section. Each leg has four sides 55, 56, 57 and 58.The length of each leg side from the base 13 to the tip or end surface, is generally the same. Each leg ends in leg end surface 59 that has four sides 60, 61, 62 and 63 representing the junction of the four sides of each leg to the end surface 59. Each of the sides of the leg surface are preferably the same length as each of the other sides of the leg surface. In the preferred embodiment each of the sides of the four leg surfaces are identical to each other. Preferably, the leg sides 60 and 62 are parallel to each other and leg sides 61 and 63 are parallel to each other. In addition, leg sides 60 is perpendicular to leg sides 61 and 63. Similarly, leg side 62 is also perpendicular to leg sides 61 and 63.

Figure 4:
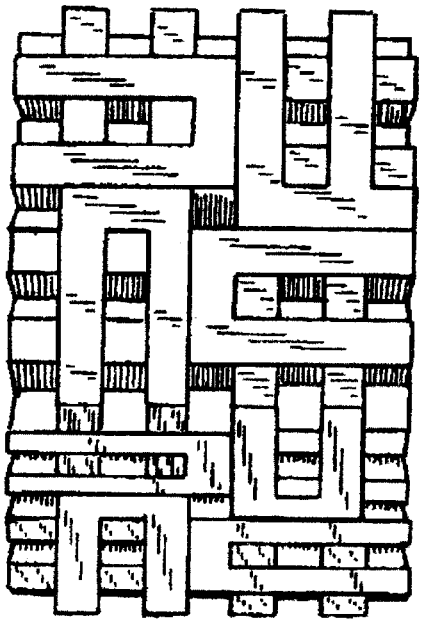
FIG. 4 is a perspective view of the assembled puzzle of the present invention.
Figure 5:
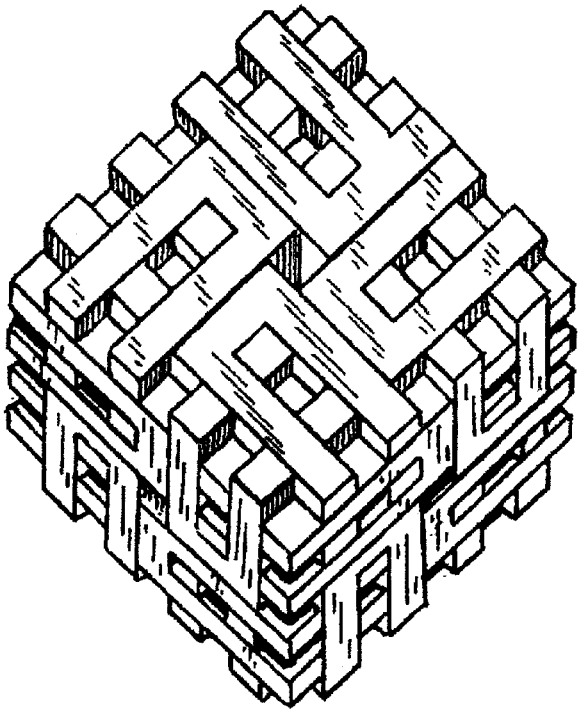
FIG. 5 shows the assembled puzzle of FIG. 5 with the cube balanced on the corner formed by the intermeshing of three puzzle pieces.

The puzzle employs twelve pieces of the type shown in FIGS. 1 to 3 to form the finished cube shown in FIG. 4. As seen in FIG. 5 one of the interesting features of the cube of the preferred embodiment of the present invention is that the cube is capable of balancing on any one of its corners. The corner of the cube is formed by the legs of three different puzzle pieces in the cube. As seen in FIG. 6 the cube of the present invention has four puzzle pieces 70, 71, 72 and 73 that form the base section of the finished cube. These four puzzle pieces are generally horizontally disposed. The four pieces of FIG. 6 intermesh together and with the four puzzle pieces 74, 75, 76 and 77 shown in FIG. 7. The puzzle pieces 74, 75, 76 and 77 shown in FIG. 7 are disposed generally vertically and at right angles to the pieces of FIG. 6. The puzzle pieces 78, 79, 80 and 81 of FIG. 8 are horizontally disposed as are the pieces of FIG. 6. The puzzle pieces of FIG. 7 intermesh with the puzzle pieces of FIGS. 6 and 8. When the pieces of FIGS. 6, 7 and 8 intermesh they form the cube shown in FIGS. 4 and 5. In FIG. 9 the top surface of the cube formed by the intermeshing of the pieces of FIGS. 6, 7, and 8. The black squares 82, 83, 84, and 85 that represent the leg surfaces of puzzle piece 74 are also viewable in FIG. 9. The black squares 86, 87, 88, and 89 that represent the leg surfaces of puzzle piece 75 are viewable in FIG. 9. The black squares 90, 91, 92, and 93 that represent the leg surfaces of puzzle piece 76 are viewable in FIG. 9. The black squares 94, 95, 96, and 97 that represent the leg surfaces of puzzle piece 77 are viewable in FIG. 9.

I claim:

1. A puzzle piece comprising a center member having a first surface and a second surface, the first surface and the second surface have four long edges and four short edges and wherein each of said edges has a first end and a second end, and wherein a first two of the long edges meet to form an angle at one of their ends and at the other end of each of said long edges each edge meets and forms an angle with a short edge, and wherein a second two of the long edges meet to form an angle at one of their ends and at the other end of each of said long edges each edge meets and forms an angle with a short edge, and wherein each of said short edges have a first and second end and wherein two of said short edges meet to form an angle and the remaining two of said short edges meet to form an angle, said central member having four legs extending from each of said first and second surfaces.

2. The puzzle piece according to claim 1 wherein each of the edges meet to form a right angle with the adjacent edge.

3. The puzzle piece according to claim 1 wherein the long edges are generally equal in length to each other.

4. The puzzle piece according to claim 1 wherein the short edges are generally equal in length to each other.

5. The puzzle piece according to claim 1 wherein each of the long edges are generally equal in length to each other and wherein each of the short edges are equal in length to each other.

6. The puzzle piece according to claim 5 wherein the length of each short edge is approximately one third the length of each long edge.

7. The puzzle piece according to claim 1 wherein the first surface and the second surface are separated from each other by sidewalls.

8. The puzzle piece according to claim 7 wherein the distance from the first surface to the second surface is the same as the length of any one of the short edges.

9. The puzzle piece according to claim 1 wherein each of the legs extending from a surface are generally square in cross section.

10. The puzzle piece according to claim 9 wherein each leg has four sides and the length of each side is generally the same.

11. The puzzle piece according to claim 10 wherein each leg ends in leg surface that has four sides representing the four sides of each leg and each of the sides of the leg surface are the same length as each of the other sides of the leg surface.

12. The puzzle piece according to claim 11 wherein the sides of the leg surface form a square.

13. A cube made from twelve of the puzzle pieces of claim 1.

14. A puzzle comprising twelve puzzle pieces according to claim 1.

15. The puzzle piece according to claim 1 wherein said first surface may be divided into fourteen generally equally sized imaginary squares A through N and said second surface may be divided into fourteen generally equally sized imaginary squares A' through N' and wherein imaginary squares A and A' are at the junction of two long edges and imaginary squares N and N' are at the junction of the other two long edges and imaginary squares A and N are opposite each other as are imaginary squares A' and N' and wherein a corner of imaginary squares I and I' are formed by the junction of two short edges and a corner of imaginary squares F and F' formed by the junction of the other two short edges and wherein one long edge is formed by a side of imaginary squares A, B, and C, a second long edge is formed by a side of imaginary squares A, D, and H, and a third long edge is formed by a side of imaginary squares G, K, and N and a fourth long edge is formed by a side of imaginary squares L, M, and N and wherein one long edge is formed by a side of imaginary squares A', B', and C', a second long edge is formed by a side of imaginary squares A', D', and H', and a third long edge is formed by a side of imaginary squares G', K', and N' and a fourth long edge is formed by a side of imaginary squares L', M', and N' and wherein a side of imaginary square C forms a short edge, a side of imaginary square G forms a short edge, a side of imaginary square H forms a short edge and a side of imaginary square L forms a short edge and wherein a side of imaginary square C' forms a short edge, a side of imaginary square G' forms a short edge, a side of imaginary square H' forms a short edge and a side of imaginary square L' forms a short edge and wherein a corner of imaginary square E is adjacent a corner of imaginary square A that is opposite the corner of imaginary square A that is formed by the junction of said two long edges and wherein a corner of imaginary square J is adjacent a corner of imaginary square N that is opposite the corner of imaginary square N that is formed by the junction of said two long edges and wherein a corner of imaginary square E' is adjacent a corner of imaginary square A' that is opposite the corner of imaginary square A' that is formed by the junction of said two long edges and wherein a corner of imaginary square J' is adjacent a corner of imaginary square N' that is opposite the corner of imaginary square N' that is formed by the junction of said two long edges.

16. The puzzle piece according to claim 15 wherein a first leg extends outwardly from the first surface from imaginary square G, a second leg extends outwardly from the first surface from imaginary square N, a third leg extends outwardly from the first surface from imaginary square L and a fourth leg extends outwardly from the first surface from imaginary square E.

17. The puzzle piece according to claim 15 wherein a first leg extends outwardly from the second surface from imaginary square C, a second leg extends outwardly from the second surface from imaginary square A, a third leg extends outwardly from the second surface from imaginary square H and a fourth leg extends outwardly from the second surface from imaginary square J.

18. The puzzle piece according to claim 15 wherein a first leg extends outwardly from the first surface from imaginary square G, a second leg extends outwardly from the first surface from imaginary square N, a third leg extends outwardly from the first surface from imaginary square L and a fourth leg extends outwardly from the first surface from imaginary square E and wherein a fifth leg extends outwardly from the second surface from imaginary square C', a sixth leg extends outwardly from the second surface from imaginary square A', a seventh leg extends outwardly from the second surface from imaginary square H' and a eighth leg extends outwardly from the second surface from imaginary square J'.

19. A puzzle piece comprising center member having a first surface and a second surface, the first surface and the second surface have four long edges and four short edges and wherein each of said edges has a first end and a second end, and wherein a first two of the long edges meet to form an angle at one of their ends and at the other end of each of said long edges each edge meets and forms an angle with a short edge, and wherein a second two of the long edges meet to form an angle at one of their ends and at the other end of each of said long edges each edge meets and forms an angle with a short edge, and wherein each of said short edges have a first and second end and wherein two of said short edges meet to form an angle and the remaining two of said short edges meet to form an angle, and wherein each of said first and second surfaces may be divided into fourteen generally equally sized imaginary squares A through N and A' through N' respectively and the location of each of the imaginary squares A through N correspond with the location of each of the respective squares A' through N' and wherein imaginary square A is at the junction of two long edges and imaginary square N is at the junction of the other two long edges and imaginary squares A and N are opposite each other and wherein a corner of imaginary square I is formed by the junction of two short edges and a corner of imaginary square F is formed by the junction of the other two short edges and wherein one long edge is formed by a side of imaginary squares A, B, and C, a second long edge is formed by a side of imaginary squares A, D, and H, and a third long edge is formed by a side of imaginary squares G, K, and N and a fourth long edge is formed by a side of imaginary squares L, M, and N and wherein a side of imaginary square C forms a short edge, a side of imaginary square G forms a short edge, a side of imaginary square H forms a short edge and a side of imaginary square L forms a short edge and wherein a corner of imaginary square E is adjacent a corner of imaginary square A that is opposite the corner of imaginary square A that is formed by the junction of said two long edges and wherein a corner of imaginary square J is adjacent a corner of imaginary square N that is opposite the corner of imaginary square N that is formed by the junction of said two long edges and wherein a first leg extends outwardly from the first surface from imaginary square G, a second leg extends outwardly from the first surface from imaginary square N, a third leg extends outwardly from the first surface from imaginary square L and a fourth leg extends outwardly from the first surface from imaginary square E and wherein a fifth leg extends outwardly from the second surface from imaginary square C', a sixth leg extends outwardly from the second surface from imaginary square A', a seventh leg extends outwardly from the second surface from imaginary square H' and a eighth leg extends outwardly from the second surface from imaginary square J'.

20. A puzzle comprising twelve pieces each piece comprising center member having a first surface and a second surface, the first surface and the second surface have four long edges and four short edges and wherein each of said edges has a first end and a second end, and wherein a first two of the long edges meet to form an angle at one of their ends and at the other end of each of said long edges each edge meets and forms an angle with a short edge, and wherein a second two of the long edges meet to form an angle at one of their ends and at the other end of each of said long edges each edge meets and forms an angle with a short edge, and wherein each of said short edges have a first and second end and wherein two of said short edges meet to form an angle and the remaining two of said short edges meet to form an angle, and wherein each of said first and second surfaces may be divided into fourteen generally equally sized imaginary squares A through N and A' through N' respectively and the location of each of the imaginary squares A through N correspond with the location of each of the respective squares A' through N' and wherein imaginary square A is at the junction of two long edges and imaginary square N is at the junction of the other two long edges and imaginary squares A and N are opposite each other and wherein a corner of imaginary square I is formed by the junction of two short edges and a corner of imaginary square F is formed by the junction of the other two short edges and wherein one long edge is formed by a side of imaginary squares A, B, and C, a second long edge is formed by a side of imaginary squares A, D, and H, and a third long edge is formed by a side of imaginary squares G, K, and N and a fourth long edge is formed by a side of imaginary squares L, M, and N and wherein a side of imaginary square C forms a short edge, a side of imaginary square G forms a short edge, a side of imaginary square H forms a short edge and a side of imaginary square L forms a short edge and wherein a corner of imaginary square E is adjacent a corner of imaginary square A that is opposite the corner of imaginary square A that is formed by the junction of said two long edges and wherein a corner of imaginary square J is adjacent a corner of imaginary square N that is opposite the corner of imaginary square N that is formed by the junction of said two long edges and wherein a first leg extends outwardly from the first surface from imaginary square G, a second leg extends outwardly from the first surface from imaginary square N, a third leg extends outwardly from the first surface from imaginary square L and a fourth leg extends outwardly from the first surface from imaginary square E and wherein a fifth leg extends outwardly from the second surface from imaginary square C', a sixth leg extends outwardly from the second surface from imaginary square A', a seventh leg extends outwardly from the second surface from imaginary square H' and a eighth leg extends outwardly from the second surface from imaginary square J'.

21. A cube formed from twelve pieces each piece comprising center member having a first surface and a second surface, the first surface and the second surface have four long edges and four short edges and wherein each of said edges has a first end and a second end, and wherein a first two of the long edges meet to form an angle at one of their ends and at the other end of each of said long edges each edge meets and forms an angle with a short edge, and wherein a second two of the long edges meet to form an angle at one of their ends and at the other end of each of said long edges each edge meets and forms an angle with a short edge, and wherein each of said short edges have a first and second end and wherein two of said short edges meet to form an angle and the remaining two of said short edges meet to form an angle, and wherein each of said first and second surfaces may be divided into fourteen generally equally sized imaginary squares A through N and A' through N' respectively and the location of each of the imaginary squares A through N correspond with the location of each of the respective squares A' through N' and wherein imaginary square A is at the junction of two long edges and imaginary square N is at the junction of the other two long edges and imaginary squares A and N are opposite each other and wherein a corner of imaginary square I is formed by the junction of two short edges and a corner of imaginary square F is formed by the junction of the other two short edges and wherein one long edge is formed by a side of imaginary squares A, B, and C, a second long edge is formed by a side of imaginary squares A, D, and H, and a third long edge is formed by a side of imaginary squares G, K, and N and a fourth long edge is formed by a side of imaginary squares L, M, and N and wherein a side of imaginary square C forms a short edge, a side of imaginary square G forms a short edge, a side of imaginary square H forms a short edge and a side of imaginary square L forms a short edge and wherein a corner of imaginary square E is adjacent a corner of imaginary square A that is opposite the corner of imaginary square A that is formed by the junction of said two long edges and wherein a corner of imaginary square J is adjacent a corner of imaginary square N that is opposite the corner of imaginary square N that is formed by the junction of said two long edges and wherein a first leg extends outwardly from the first surface from imaginary square G, a second leg extends outwardly from the first surface from imaginary square N, a third leg extends outwardly from the first surface from imaginary square L and a fourth leg extends outwardly from the first surface from imaginary square E and wherein a fifth leg extends outwardly from the second surface from imaginary square C', a sixth leg extends outwardly from the second surface from imaginary square A', a seventh leg extends outwardly from the second surface from imaginary square H' and a eighth leg extends outwardly from the second surface from imaginary square J'.

22. The cube according to claim 21 wherein said cube is capable of balancing on a single corner formed by said pieces.

* * * * *